US005498759A

United States Patent [19]

Nakada et al.

[11] Patent Number: 5,498,759

[45] Date of Patent: Mar. 12, 1996

[54] SURFACE TREATMENT METHOD FOR ALUMINUM

[75] Inventors: Kazuya Nakada, Hiratsuka; Masayuki Yoshida, Yokohama, both of Japan

[73] Assignee: Henkel Corporation, Plymouth Meeting, Pa.

[21] Appl. No.: 170,246

[22] PCT Filed: Jun. 11, 1992

[86] PCT No.: PCT/US92/04698

§ 371 Date: Dec. 27, 1993

§ 102(e) Date: Dec. 27, 1993

[87] PCT Pub. No.: WO93/00457

PCT Pub. Date: Jan. 7, 1993

[30] Foreign Application Priority Data

Jun. 26, 1991 [JP] Japan ..... 3-180563

[51] Int. Cl.[6] ..... B32B 7/12

[52] U.S. Cl. ..... 427/353; 427/354; 427/421; 427/427

[58] Field of Search ..... 427/353, 354, 427/421, 427

[56] References Cited

U.S. PATENT DOCUMENTS

| | | | |
|---|---|---|---|
| 2,438,877 | 3/1948 | Spruance | 148/6.16 |
| 4,775,427 | 10/1988 | Portz et al. | 148/6.16 |
| 4,812,175 | 3/1987 | Reghi | 148/258 |

FOREIGN PATENT DOCUMENTS

| | | | |
|---|---|---|---|
| 656609 | 4/1965 | Belgium . | |
| 213590 | 3/1987 | European Pat. Off. | C23C 22/37 |
| 261519 | 3/1988 | European Pat. Off. | C23C 22/44 |
| 63086875 | 4/1988 | Japan | C23C 22/17 |
| 1087757 | 11/1965 | United Kingdom | C23F 7/26 X |

*Primary Examiner*—Benjamin Utech
*Attorney, Agent, or Firm*—Wayne C. Jaeschke; Norvell E. Wisdom, Jr.; Beatrice N. Robbins

[57] ABSTRACT

The cleaned surface of an aluminum or aluminum alloy product, for example, aluminum coil, is treated with a 0.5 to 3 second spray of a chromating bath heated to 40° to 60° C., said bath having a pH of 1.0 to 3.0 and containing 0.1 to 3.0 g/L of tungstate ions and/or molybdate ions, 0.5 to 4.0 g/L of hexavalent chromium ions, 5.0 to 30.0 g/L of phosphate ions, and 0.05 to 2.0 g/L of free fluoride ions. A highly corrosion-resistant, highly paint-adherent chromate coating can thereby be formed on the surface of aluminum in less time than that required by prior phosphoric acid-based chromating treatments.

17 Claims, No Drawings

SURFACE TREATMENT METHOD FOR ALUMINUM

TECHNICAL FIELD

The present invention relates to a novel method for rapidly treating the surface of aluminum and aluminum alloy (hereinafter jointly described simply as "aluminum", unless the context implies otherwise), a method which rapidly produces on the aluminum a conversion film having a chromium add-on equivalent to the chromium add-on of films produced by prior phosphoric acid-based chromating treatments and which provides the aluminum surface with an excellent corrosion resistance and paint adherence. The present invention is particularly well suited for treating the surface of aluminum coil.

BACKGROUND ART

Conversion treatments which provide the surface of aluminum with an excellent corrosion resistance and paint adherence are typified by chromic acid-based chromating treatments and phosphoric acid-based chromating treatments. The conversion coatings produced by chromic acid-based chromating treatments (Japanese Patent Publication Number 45-41088 [41,088/70] and British Patent Number 1,087,757) contain hexavalent chromium and therefore have a yellow or gold color. Thus, the color of this film will remain visible when a clear coat is applied on the surface. Moreover, since the conversion coating contains toxic hexavalent chromium, the development of a Cr(VI)-free conversion coating is desired.

In contrast to the preceding, the coatings formed by phosphoric acid-based chromating treatments do not contain hexavalent chromium and thus are colorless. As a result, the use of this treatment has been spreading in recent years. The phosphoric acid-based chromating treatment disclosed in U.S. Pat. No. 2,438,877 employs a treatment bath of chromic acid ($CrO_3$), orthophosphoric acid ($H_3PO_4$), and hydrofluoric acid (HF), and the principal component of the resulting film is chromic phosphate hydrate ($CrPO_4 \cdot 4H_2O$). When this particular phosphoric acid-based chromating treatment is run in an aluminum coil line using the older conversion treatment and times of 5 to 10 seconds, a strongly corrosion-resistant, highly paint-adherent conversion coating having a chromium add-on of 20 to 50 mg/m$^2$ is produced thereby.

Also within the sphere of Cr(VI)-free conversion treatment baths, Japanese Patent Application Laid Open [Kokai or Unexamined] Number 63-86875 [86,875/88] teaches the addition of molybdate to a zinc phosphate conversion treatment bath. However, the purpose of this conversion treatment bath is to passivate the surface of composite materials fabricated from different types of metals, and it also contains trivalent chromium, zinc oxide, and acetate as essential components in addition to molybdate.

DISCLOSURE OF THE INVENTION

On the subject of the aforementioned phosphoric acid-based chromating treatments, aluminum coil lines have been operated at increasing speeds in recent years in order to improve their productivity, and conversion treatment times have been shortened to 1 to 3 seconds. However, a highly corrosion-resistant, highly paint-adherent conversion film having a chromium add-on $\geqq$20 mg/m$^2$ essentially cannot be produced when prior phosphoric acid-based chromating treatments are installed in these accelerated lines, thus creating a problem which largely cannot be addressed by prior phosphoric acid-based chromating treatments. Accordingly, the development of a phosphoric acid-based chromating treatment which can generate a conversion coating having a chromium add-on $\geqq$20 mg/m$^2$ at conversion treatment times $\leqq$3 seconds is desired.

The above-described problem was carefully examined, and it was discovered as a result that a conversion film with an unusually good corrosion resistance and paint adherence can be formed on the surface of aluminum by spraying same for 0.5 to 3 seconds with a chromating bath (heated to 40° to 60° C.) which has a pH of 1.0 to 3.0 and which contains 0.1 to 3.0 g/L of ions selected from tungstate ion and/or molybdate ions, 0.5 to 4.0 g/L of hexavalent chromium ions, 5.0 to 30.0 g/L of phosphate ions, and 0.05 to 2.0 g/L free fluoride ion. The present invention was developed as a result of this discovery.

A source of tungstate ($WO_4^{2-}$) ions source is exemplified by tungstate salts such as, for example, ammonium tungstate, potassium tungstate, sodium tungstate, and lithium tungstate, and sodium tungstate is particularly preferred. The concentration of these ions preferably falls within the range of 0.1 to 3.0 g/L for the following reasons: At less than 0.1 g/L, a satisfactory chromium add-on is not obtained even by spraying for 3 seconds, thereby precluding a good corrosion resistance and paint adherence; at more than 3.0 g/L, the risk arises of the formation (and sedimentation) of salts formed with heavy metals such as chromium.

A source of molybdate ($MoO_4^{2-}$) ions is exemplified by molybdate salts such as, for example, ammonium molybdate, potassium molybdate, sodium molybdate, and lithium molybdate, and sodium molybdate is particularly preferred. The concentration of these ions preferably falls within the range of 0.1 to 3.0 g/L for the following reasons: At less than 0.1 g/L, a satisfactory chromium add-on is not obtained even by spraying for 3 seconds, thereby precluding a good corrosion resistance and paint adherence; at more than 3.0 g/L, the risk arises of the formation (and sedimentation) of salts formed with heavy metals such as chromium.

A satisfactory operation of the method according to the invention is also obtained when the chromating bath employed contains both tungstate ions and molybdate ions at a total concentration of 0.1 to 3.0 g/L.

Chromic acid ($CrO_3$) is preferably used to supply the hexavalent chromium ion. The concentration of these ions preferably falls within the range of 0.5 to 4.0 g/L for the following reasons: Less than 0.5 g/L prevents the satisfactory development of the conversion film, resulting in a diminished corrosion resistance; exceeding 4.0 g/L makes the treatment bath harder to treat for disposal and is therefore economically and environmentally disadvantageous.

Orthophosphoric acid ($H_3PO_4$) is preferably employed to supply the phosphate ions. The concentration of these ions preferably falls within the range of 5.0 to 30.0 g/L for the following reasons: At below 5.0 g/L, the resulting film contains only a small quantity of chromic phosphate and thus has a diminished paint adherence; a good film is formed with concentrations above 30.0 g/L, but the corresponding bath cost is so high as to be economically disadvantageous.

The free fluoride ions are the crucial component for controlling or influencing the growth rate of the conversion film. A source of free fluoride ions is exemplified by hydrofluoric acid, by fluorides such as sodium fluoride and ammonium fluoride, and by complex fluorides such as the fluosilicates and fluoborates. The free fluoride ion concentration in the chromating bath was determined using an ion-selective electrode (the F-125 fluoride-selective electrode and HS-305DP reference electrode from Toa Denpa Kogyo Kabushiki Kaisha) and an ion meter (the IM40S from Toa Denpa Kogyo Kabushiki Kaisha). The ion meter was calibrated using a reference solution prepared by the addition of a known quantity of hydrofluoric acid (for example, 0.1 g/L, 1 g/L, or 10 g/L) to 5 g/L chromic acid and 15 g/L orthophosphoric acid and adjusting the pH to 2.0 with orthophosphoric acid or sodium hydroxide. The free fluoride ion concentration in this reference solution corresponded to the total quantity of fluorine in the hydrofluoric acid added. Then, after adjusting the pH of the chromating bath to 2.0 with orthophosphoric acid or sodium hydroxide, it was measured using the fluorine ion meter, and the obtained measured value was taken as the free fluoride ion concentration. The free fluoride ion concentration preferably falls within the range of 0.05 to 2.0 g/L and more preferably within the range of 0.1 to 2.0 g/L. At below 0.05 g/L, the conversion coating grows too slowly, which causes a low productivity since a lengthy treatment is then required to generate a satisfactory coating. At above 2.0 g/L, severe aluminum etching occurs and a coating is not formed.

The pH of the chromating bath must be adjusted to within the range of 1.0 to 3.0, and sodium hydroxide or ammonium hydroxide or an acid such as orthophosphoric acid, nitric acid, hydrochloric acid, and the like is preferably used as appropriate for this pH adjustment. At below pH 1.0, severe etching occurs and film formation is hindered. When the pH exceeds 3.0, etching is weak and a uniform coating cannot usually be formed.

The surface treatment method according to the present invention can be used as a substitute for the phosphoric acid-based chromating treatment which is in wide use at the present time. The surface of the aluminum should normally first be cleaned when executing a chromating treatment on the surface of aluminum using the surface treatment method according to the present invention. The cleaning method here encompasses treatment with an acidic, alkaline, or solvent-based cleaning solution or a combination thereof.

The cleaned aluminum surface can also be subsequently etched with acid or alkali as desired. Treatment with the chromating bath employed by the present invention is conducted by spraying, and the treatment temperature at this point should fall within the range of 40° to 60° C. Spraying this chromating bath (held in the aforementioned temperature range) on a clean surface of aluminum for 0.5 to 3 seconds will form thereon a chromic phosphate hydrate ($CrPO_4 \cdot 4H_2O$) coating having a chromium add-on of at least 20 mg/m$^2$.

The chromated aluminum surface is then normally rinsed with water and finally drained and dried. These water rinse and drying steps are not narrowly restricted within the context of the present invention, and they may be implemented using means known in the art. However, the drain and dry step is preferably conducted at an aluminum sheet temperature of approximately 60° to 80° C. The chromium add-on preferably falls within the range of 20 to 40 milligrams per square meter (hereinafter abbreviated as "mg/m$^2$") of the surface treated. Based on a consideration of the required corrosion resistance, the chromium add-on can be controlled by appropriately adjusting the bath concentration and temperature and the spray time.

EXAMPLES

The present invention is explained below using several illustrative examples, whose utility is compared with comparison examples.

JIS 6063 aluminum alloy was used as the substrate. A small sprayer was used for degreasing and chromating this aluminum alloy, and this small sprayer was designed to give the same spray conditions as on a present-day continuous spray treatment line for chromating aluminum coil.

The corrosion resistance was evaluated using salt spray testing and hot water immersion testing. Salt spray testing was conducted in accordance with JIS Z 2371, and the extent of corrosion development on the unpainted chromated sheet was evaluated using rating numbers after spraying for 150 hours. In this system, higher rating numbers indicate a better corrosion resistance, and a rating number at or above 9.0 is deemed satisfactory. The hot water immersion test was run by immersing the chromated sheet in hot water for 30 minutes and then visually inspecting for changes in surface color. A five-level scale was used for evaluation in the hot water immersion test, with scores ranging from 1 (poor) to 5 (excellent).

In order to evaluate the paint adherence, a commercial black spray acrylic lacquer was applied to a film thickness of 5 to 10 micrometers on the chromated aluminum alloy sheet and baked at 200° C. for 10 minutes to afford the test sheet. A 4.5 mm protrusion was executed in the painted test sheet according to Erichsen test method A in JIS Z 2247, and paint film peeling on the protruded region was visually evaluated after peeling with tape (primary adhesion). In order to evaluate the water resistance of the adhesion, the painted sheet was immersed in hot water for 30 minutes, a 4.5 mm protrusion was then executed in the painted test sheet according to Erichsen test method A in JIS Z 2247, and paint film peeling on the protruded region was visually evaluated after peeling with tape (secondary adhesion). A five-level scale was used for evaluation of the paint adherence, with scores ranging from 1 (poor) to 5 (excellent).

The chromium add-on in the chromate film was determined using an X-ray fluorescence analyzer (model 3070E from Kabushiki Kaisha Rigaku).

EXAMPLE 1

The surface of the aluminum alloy was cleaned by rinsing for 2 seconds with a hot (70° C.) 2% aqueous solution of a commercial alkaline degreaser (FINECLEANER™ 4377A, registered brand name of Nihon Parkerizing Company, Limited) followed by rinsing with water. This was followed by a 2 second spray with chromating bath 1 heated to 50° C., rinsing with water, spraying for 2 seconds with deionized water (≧3,000,000 ohm-cm), and finally drying with hot air at 70° C. for 1 minute. After drying, the corrosion resistance and paint adherence were evaluated under the conditions described above.

EXAMPLE 2

The aluminum alloy was cleaned under the same conditions as in Example 1 and was then sprayed for 2 seconds with chromating bath 2 heated to 50° C. After treatment, washing and drying were carried out under the same conditions as in Example 1, and performance evaluation was conducted as above.

TABLE 1

Composition of Chromating Bath 1

| Component | Content of Component |
|---|---|
| Sodium tungstate ($Na_2WO_4.2H_2O$) | 2.5 g/L ($WO_4^{2-}$ 1.9 g/L) |

TABLE 1-continued

| Composition of Chromating Bath 1 | |
|---|---|
| Component | Content of Component |
| Chromic acid ($CrO_3$) | 5.0 g/L ($Cr^{6+}$ 2.6 g/L) |
| 75% phosphoric acid ($H_3PO_4$) | 30.0 g/L ($PO_4^{3-}$ 21.8 g/L) |
| 20% hydrofluoric acid (HF) | 8.5 g/L (free $F^-$ 1.6 g/L) |
| pH: 2.0 (adjusted with sodium hydroxide) | |

TABLE 2

| Composition of Chromating Bath 2 | |
|---|---|
| Component | Content of Component |
| Sodium tungstate ($Na_2WO_4.2H_2O$) | 0.5 g/L ($WO_4^{2-}$ 0.4 g/L) |
| Chromic acid ($CrO_3$) | 3.5 g/L ($Cr^{6+}$ 1.8 g/L) |
| 75% phosphoric acid ($H_3PO_4$) | 16.8 g/L ($PO_4^{3-}$ 12.2 g/L) |
| 20% hydrofluoric acid (HF) | 6.5 g/L (free $F^-$ 1.2 g/L) |
| pH: 2.0 (adjusted with sodium hydroxide) | |

EXAMPLE 3

The aluminum alloy was cleaned under the same conditions as in Example 1 and was then sprayed for 2 seconds with chromating bath 3 heated to 50° C. After treatment, washing and drying were carried out under the same conditions as in Example 1, and performance evaluation was conducted as above.

TABLE 3

| Composition of Chromating Bath 3 | |
|---|---|
| Component | Content of Component |
| Sodium tungstate ($Na_2WO_4.2H_2O$) | 1.0 g/L ($WO_4^{2-}$ 0.8 g/L) |
| Chromic acid ($CrO_3$) | 1.6 g/L ($Cr^{6+}$ 0.8 g/L) |
| 75% phosphoric acid ($H_3PO_4$) | 9.0 g/L ($PO_4^{3-}$ 6.5 g/L) |
| Ammonium fluoride ($NH_4F$) | 1.5 g/L (free $F^-$ 0.7 g/L) |
| pH: 1.4 (adjusted with orthophosphoric acid) | |

EXAMPLE 4

The aluminum alloy was cleaned under the same conditions as in Example 1 and was then sprayed for 2 seconds with chromating bath 4 heated to 50° C. After treatment, washing and drying were carried out under the same conditions as in Example 1, and performance evaluation was conducted as above.

TABLE 4

| Composition of Chromating Bath 4 | |
|---|---|
| Component | Content of Component |
| Sodium molybdate ($Na_2MoO_4.2H_2O$) | 3.6 g/L ($MoO_4^{2-}$ 2.4 g/L) |
| Chromic acid ($CrO_3$) | 5.0 g/L ($Cr^{6+}$ 2.6 g/L) |
| 75% phosphoric acid ($H_3PO_4$) | 30.0 g/L ($PO_4^{3-}$ 21.8 g/L) |
| Sodium fluoride (NaF) | 3.0 g/L (free $F^-$ 1.3 g/L) |
| pH: 2.0 (adjusted with sodium hydroxide) | |

EXAMPLE 5

The aluminum alloy was cleaned under the same conditions as in Example 1 and was then sprayed for 2 seconds with chromating bath 5 heated to 50° C. After treatment, washing and drying were carried out under the same conditions as in Example 1, and performance evaluation was conducted as above.

TABLE 5

| Composition of Chromating Bath 5 | |
|---|---|
| Component | Content of Component |
| Sodium molybdate ($Na_2MoO_4.2H_2O$) | 0.5 g/L ($MoO_4^{2-}$ 0.3 g/L) |
| Chromic acid ($CrO_3$) | 3.5 g/L ($Cr^{6+}$ 1.6 g/L) |
| 75% phosphoric acid ($H_3PO_4$) | 16.8 g/L ($PO_4^{3-}$ 12.2 g/L) |
| 20% hydrofluoric acid (HF) | 6.5 g/L (free $F^-$ total |
| 40% fluosilicic acid ($H_2SiF_6$) | 3.0 g/L of 1.3 g/L) |
| pH: 2.0 (adjusted with sodium hydroxide) | |

EXAMPLE 6

The aluminum alloy was cleaned under the same conditions as in Example 1 and was then sprayed for 2 seconds with chromating bath 6 heated to 50° C. After treatment, washing and drying were carried out under the same conditions as in Example 1, and performance evaluation was conducted as above.

TABLE 6

| Composition of Chromating Bath 6 | |
|---|---|
| Component | Content of Component |
| Sodium molybdate ($Na_2MoO_4.2H_2O$) | 1.2 g/L ($MoO_4^{2-}$ 0.8 g/L) |
| Chromic acid ($CrO_3$) | 1.6 g/L ($Cr^{6+}$ 0.8 g/L) |
| 75% phosphoric acid ($H_3PO_4$) | 9.0 g/L ($PO_4^{3-}$ 6.5 g/L) |
| 20% hydrofluoric acid (HF) | 4.0 g/L (free $F^-$ 0.7 g/L) |
| pH: 1.4 (adjusted with orthophosphoric acid) | |

EXAMPLE 7

The aluminum alloy was cleaned under the same conditions as in Example 1 and was then sprayed for 2 seconds with chromating bath 7 heated to 50° C. After treatment, washing and drying were carried out under the same conditions as in Example 1, and performance evaluation was conducted as above.

TABLE 7

| Composition of Chromating Bath 7 | |
|---|---|
| Component | Content of Component |
| Sodium tungstate ($Na_2WO_4.2H_2O$) | 1.0 g/L ($WO_4^{2-}$ 0.8 g/L) |
| Sodium molybdate ($Na_2MoO_4.2H_2O$) | 0.9 g/L ($MoO_4^{2-}$ 0.6 g/L) |
| Chromic acid ($CrO_3$) | 6.0 g/L ($Cr^{6+}$ 3.1 g/L) |
| 75% phosphoric acid ($H_3PO_4$) | 25.0 g/L ($PO_4^{3-}$ 18.2 g/L) |
| 20% hydrofluoric acid (HF) | 6.0 g/L (free $F^-$ 1.1 g/L) |
| pH: 1.4 (adjusted with orthophosphoric acid) | |

EXAMPLE 8

The aluminum alloy was cleaned under the same conditions as in Example 1 and was then sprayed for 1 second with chromating bath 1 heated to 60° C. After treatment, washing and drying were carried out under the same conditions as in Example 1, and performance evaluation was conducted as above.

EXAMPLE 9

The aluminum alloy was cleaned under the same conditions as in Example 1 and was then sprayed for 1 second with chromating bath 4 heated to 60° C. After treatment, washing and drying were carried out under the same conditions as in Example 1, and performance evaluation was conducted as above.

Comparison Example 1

The aluminum alloy was cleaned under the same conditions as in Example 1 and was then sprayed for 2 seconds with chromating bath 8 heated to 50° C. After treatment, washing and drying were carried out under the same conditions as in Example 1, and performance evaluation was conducted as above.

TABLE 8

| Composition of Chromating Bath 8 | |
|---|---|
| Component | Content of Component |
| Sodium tungstate($Na_2WO_4.2H_2O$) | 0.05 g/L ($WO_4^{2-}$ 0.04 g/L) |
| Chromic acid ($CrO_3$) | 4.5 g/L ($Cr^{6+}$ 2.3 g/L) |
| 75% phosphoric acid ($H_3PO_4$) | 16.8 g/L ($PO_4^{3-}$ 12.2 g/L) |
| Ammonium fluoride ($NH_4F$) | 2.5 g/L (free $F^-$ 1.2 g/L) |
| pH: 2.0 (adjusted with sodium hydroxide) | |

Comparison Example 2

The aluminum alloy was cleaned under the same conditions as in Example 1 and was then sprayed for 2 seconds with chromating bath 9 heated to 50° C. After treatment, washing and drying were carried out under the same conditions as in Example 1, and performance evaluation was conducted as above.

TABLE 9

| Composition of Chromating Bath 9 | |
|---|---|
| Component | Content of Component |
| Sodium molybdate ($Na_2MoO_4.2H_2O$) | 0.06 g/L ($MoO_4^{2-}$ 0.04 g/L) |
| Chromic acid ($CrO_3$) | 4.5 g/L ($Cr^{6+}$ 2.3 g/L) |
| 75% phosphoric acid ($H_3PO_4$) | 16.8 g/L ($PO_4^{3-}$ 12.2 g/L) |
| 20% hydrofluoric acid (HF) | 6.5 g/L (free$^-$ 1.2 g/L) |
| pH: 2.0 (adjusted with sodium hydroxide) | |

Comparison Example 3

The aluminum alloy was cleaned under the same conditions as in Example 1 and was then sprayed for 2 seconds with chromating bath 10 heated to 50° C. After treatment, washing and drying were carried out under the same conditions as in Example 1, and performance evaluation was conducted as above.

TABLE 10

| Composition of Chromating Bath 10 | |
|---|---|
| Component | Content of Component |
| Sodium tungstate ($Na_2WO_4.2H_2O$) | 0.05 g/L ($WO_4^{2-}$ 0.04 g/L) |
| Sodium molybdate ($Na_2MoO_4.2H_2O$) | 0.05 g/L ($MoO_4^{2-}$ 0.03 g/L) |
| Chromic acid ($CrO_3$) | 5.0 g/L ($Cr^{6+}$ 2.6 g/L) |
| 75% phosphoric acid ($H_3PO_4$) | 19.0 g/L ($PO_4^{3-}$ 13.8 g/L) |
| 20% hydrofluoric acid (HF) | 6.0 g/L (free $F^-$ 1.1 g/L) |
| pH: 1.4 (adjusted with orthophosphoric acid) | |

Comparison Example 4

The aluminum alloy was cleaned under the same conditions as in Example 1 and was sprayed for 2 seconds with a 4% aqueous solution of a commercial phosphoric acid-based chromating agent (ALCHROM™ K702, registered brand name of Nihon Parkerizing Company, Limited), heated to 50° C. After treatment, washing and drying were carried out under the same conditions as in Example 1, and performance evaluation was conducted as above.

The results of these examples and comparison examples, as reported in Table 11, confirm that the present invention produces an excellent corrosion resistance and excellent paint adherence.

TABLE 11

| Results of Evaluation Testing | | | | | |
|---|---|---|---|---|---|
| | | Corrosion Resistance Tests | | | |
| | Chromium | SST, 150 | Hot Water | Paint Adherence Tests | |
| | Add-on, mg/m$^2$ | Hours, Rating | Immersion | Primary | Secondary |
| Example 1 | 29 | 9.8 | 5 | 5 | 4 |
| Example 2 | 22 | 9.5 | 5 | 5 | 4 |
| Example 3 | 20 | 9.2 | 5 | 5 | 4 |
| Example 4 | 28 | 9.7 | 5 | 5 | 4 |
| Example 5 | 21 | 9.3 | 5 | 5 | 4 |
| Example 6 | 20 | 9.0 | 5 | 5 | 4 |
| Example 7 | 29 | 9.8 | 5 | 5 | 4 |
| Example 8 | 22 | 9.2 | 5 | 5 | 4 |
| Example 9 | 22 | 9.2 | 5 | 5 | 4 |
| Comparison Example 1 | 15 | 7.0 | 4 | 4 | 3 |
| Comparison Example 2 | 15 | 7.0 | 4 | 4 | 3 |
| Comparison Example 3 | 15 | 7.0 | 4 | 4 | 3 |
| Comparison Example 4 | 13 | 6.0 | 3 | 3 | 2 |

Benefits of the Invention

As explained hereinbefore, the present invention provides a highly corrosion-resistant, highly paint-adherent chromate coating on the surface of aluminum in less time than that required for prior phosphoric acid-based chromate treatments. This is achieved by spraying an acidic chromating bath that contains free fluoride ion, phosphate ion, hexavalent chromium ion, and tungstate ion and/or molybdate ion.

The invention claimed is:

1. A method for treating an aluminum surface to provide thereon a corrosion protective and paint adherence promoting layer by spraying the surface for 0.5 to not more than 3 seconds with a chromating solution at a temperature of 40° to 60° C. and a pH of 1.0 to 3.0, said chromating solution consisting essentially of:

(A) from 0.1 to 3.0 g/L of ions selected from the group consisting of tungstate ions, molybdate ions and both tungstate and molybdate ions;

(B) from 0.5 to 4.0 g/L, measured as hexavalent chromium, of ions containing hexavalent chromium;

(C) from 5.0 to 30.0 g/L of phosphate ions; and (D) from 0.05 to 2.0 g/L of free fluoride ions wherein the areal density of chromium in said corrosion protective and paint adherence promoting layer is at least 20 mg/m$^2$.

2. A method according to claim 1, wherein the chromating solution contains from 0.1 to 2.0 g/L of free fluoride ions.

3. A method according to claim 2, wherein the areal density of chromium in the corrosion protective and paint adherence promoting layer formed during the process is not more than 40 mg/m$^2$.

4. A method according to claim 3, wherein, in the chromating solution, the content of component (A) is derived from dissolved sodium tungstate, sodium molybdate, or a mixture thereof; the content of hexavalent chromium is derived from dissolved chromic acid; the content of phosphate ions is derived from dissolved orthophosphoric acid; and the content of free fluoride is derived from at least one of hydrofluoric acid, sodium fluoride, ammonium fluoride, and fluorosilicic acid.

5. A method according to claim 4, wherein the aluminum surface contacted is that of aluminum coil.

6. A method according to claim 5, comprising additional steps of rinsing the aluminum surface after chromating and drying the rinsed surface at an aluminum temperature of 60°– 80° C.

7. A method according to claim 6, wherein the aluminum surface contacted is that of aluminum coil, and the method additionally comprises the steps of rinsing the aluminum surface and subsequently drying at an aluminum temperature of 60°–80° C.

8. A method according to claim 4, wherein the aluminum surface contacted is that of aluminum coil, and the method additionally comprises the steps of rinsing the aluminum surface and subsequently drying at an aluminum temperature of 60°–80° C.

9. A method according to claim 3, wherein the aluminum surface contacted is that of aluminum coil, and the method additionally comprises the steps of rinsing the aluminum surface and subsequently drying at an aluminum temperature of 60°–80° C.

10. A method according to claim 2, wherein the aluminum surface contacted is that of aluminum coil, and the method includes additional steps of rinsing the aluminum surface after chromating and drying the rinsed surface at an aluminum temperature of 60°–80° C.

11. A method according to claim 2, wherein the aluminum surface contacted is that of aluminum coil, and the method additionally comprises the steps of rinsing the aluminum surface and subsequently drying at an aluminum temperature of 60°–80° C.

12. A method according to claim 1, wherein the areal density of chromium in the corrosion protective and paint adherence promoting layer formed during the process is not more than 40 mg/m$^2$.

13. A method according to claim 12, wherein the aluminum surface contacted is that of aluminum coil, and the method additionally comprises the steps of rinsing the aluminum surface and subsequently drying at an aluminum temperature of 60°–80° C.

14. A method according to claim 1, wherein, in the chromating solution, the content of component (A) is derived from dissolved sodium tungstate, sodium molybdate, or a mixture thereof; the content of hexavalent chromium is derived from dissolved chromic acid; the content of phosphate ions is derived from dissolved orthophosphoric acid; and the content of free fluoride is derived from at least one of hydrofluoric acid, sodium fluoride, ammonium fluoride, and fluorosilicic acid.

15. A method according to claim 14 wherein the aluminum surface contacted in that of aluminum coil, and the method additionally comprises the steps of rinsing the aluminum surface and subsequently drying at an aluminum temperature of 60°–80° C.

16. A method according to claim 1, wherein the aluminum surface contacted is that of aluminum coil, and the method includes additional steps of rinsing the aluminum surface after chromating and drying the rinsed surface at an aluminum temperature of 60°–80° C.

17. A method according to claim 1, wherein the aluminum surface contacted is that of aluminum coil, and the method additionally comprises the steps of rinsing the aluminum surface and subsequently drying at an aluminum temperature of 60°–80° C.

* * * * *